US006565432B2

(12) United States Patent
Moody

(10) Patent No.: US 6,565,432 B2
(45) Date of Patent: May 20, 2003

(54) AUTO HOLD VIDEO POKER

(76) Inventor: Ernest W. Moody, 2116 Redbird Dr., Las Vegas, NV (US) 89134

( * ) Notice: Subject to any disclaimer, the term of this patent is extended or adjusted under 35 U.S.C. 154(b) by 0 days.

(21) Appl. No.: 09/956,291

(22) Filed: Sep. 17, 2001

(65) Prior Publication Data

US 2002/0125641 A1 Sep. 12, 2002

Related U.S. Application Data

(60) Provisional application No. 60/233,349, filed on Sep. 18, 2000.

(51) Int. Cl.[7] ..... A63F 1/00

(52) U.S. Cl. ..... 463/13; 273/274; 273/292; 273/309; 463/12; 463/20

(58) Field of Search ..... 273/292, 274, 273/309; 463/12, 13, 20

(56) References Cited

U.S. PATENT DOCUMENTS 4,926,327 A * 5/1990 Sidley ..... 359/501
5,531,448 A * 7/1996 Moody ..... 273/292
5,732,950 A * 3/1998 Moody ..... 273/292
5,772,506 A * 6/1998 Marks et al. ..... 463/13
5,775,992 A * 7/1998 Wood et al. ..... 273/274
5,785,593 A * 7/1998 Wood et al. ..... 273/292
5,816,916 A * 10/1998 Moody ..... 273/292
5,823,873 A * 10/1998 Moody ..... 273/292
5,882,259 A * 3/1999 Holmes et al. ..... 273/292
5,882,260 A * 3/1999 Marks et al. ..... 273/292
5,957,774 A * 9/1999 Holmes et al. ..... 273/292
6,007,066 A * 12/1999 Moody ..... 273/292
6,045,129 A * 4/2000 Cooper et al. ..... 273/292
6,098,985 A * 8/2000 Moody ..... 273/292
6,132,311 A * 10/2000 Williams ..... 273/292
6,176,781 B1 * 1/2001 Walker et al. ..... 273/292
6,334,613 B1 * 1/2002 Yoseloff ..... 273/274
6,342,007 B1 * 1/2002 Wood et al. ..... 273/292
6,419,578 B1 * 7/2002 Moody et al. ..... 273/274

OTHER PUBLICATIONS

Wood et al., Poker Game—Pub. No. US 2002/0037762 A1—Mar. 28, 2002.*

* cited by examiner

*Primary Examiner*—Benjamin H. Layno
*Assistant Examiner*—Dolores Collins
(74) *Attorney, Agent, or Firm*—John Edward Roethel

(57) ABSTRACT

A video poker machine is provided with an auto hold feature that can be selectively turned on or off by the player. When the player uses the auto hold feature, the player plays against a first pay table which has a first theoretical game return. If the player does not use the auto hold feature, then the player plays against a second pay table with a slighter better theoretical game return than the first pay table.

3 Claims, No Drawings

AUTO HOLD VIDEO POKER

CROSS-REFERENCE TO RELATED APPLICATION

This application is based on and claims the benefit of U.S. Provisional Application Serial No. 60/233349, filed Sep. 18, 2000.

This application relates to a method of playing video poker and more particularly to a method of playing video poker in which an auto hold feature is added to the game. If the player elects to use the auto hold feature, the player plays against a first pay table. If the player declines to use the auto hold feature, the player plays against a second, more favorable pay table.

BACKGROUND OF THE INVENTION

A well known game of chance offered to players in most gaming casinos is video draw poker. After making a wager, the player is dealt five cards face up. The player selects which cards, if any, the player wishes to hold, the unheld cards are discarded and replacement cards are dealt for the discarded cards. The final five card hand is analyzed to determine its poker hand ranking and the player is paid for winning poker hand rankings based on the amount of the player's wager. A pay table is displayed to the player showing the amounts that the player can win based on the poker hand ranking achieved by the player and the amount wagered by the player.

In traditional video poker, the player must analyze each initial hand presented to the player to try and determine which are the most favorable cards to hold. In order to be able to do this is accurately and correctly on every single starting hand presented to the player, the player must have an intimate knowledge of the mathematical probabilities for improving any particular starting five card hand. Then this knowledge of the mathematical probabilities must be blended into the particular pay table being offered to the player so that the correct hold of the initial starting hand can be made.

Many gaming machine manufacturers offer what is known as an "auto hold" feature on their gaming machines. When an auto hold feature is in use, the computer controls of the gaming machine analyze the initially displayed hand and suggest a HOLD to those cards that would give the player the best mathematical probability for that initial hand based on the pay table that is being used. The player can accept the suggested auto hold by pressing the DRAW location on the touch screen video display or the DRAW button on the button panel and the draw step will take place using the HOLD cards suggested by the auto hold. If the player declines the suggested auto hold, the player must unhold any cards that were held by the auto hold if the player wishes to discard those cards and the player must manually hold any other cards that the player wishes to hold. The use of an auto hold feature speeds up play by increasing the number of hands per hour that can be played on the gaming machine and also improves the player's chances of having a winning session during the play of video poker.

Gaming machines that provide an auto hold feature merely allow the player to play video poker at the level of the actual game return and eliminate the possibility of player error. However, it can be said that playing video poker using an auto hold takes the skill out of the play of the game. Many video poker players relish the challenge of video poker and wish to incorporate their skill and ability into their play.

It is an object of the present invention to provide players with the option of either using the auto hold feature or playing without the auto hold feature.

It is a feature of the present invention to provide an option to the player. If the player wants to play the video poker machine and use the auto hold feature, the player plays against a first pay table. If the player wants to play the video poker machine and not use the auto hold feature, then the player plays against a second pay table with a slighter better return than the first pay table.

It is an advantage of the present invention that the player can play the video poker machine using the auto hold feature and eliminate any possibility of play error affecting the theoretical game return. Or the player can play the video poker game without using the auto hold feature and have a higher theoretical game return, but risk the fact that the player's skill (or lack thereof) will affect the actual game return.

Other objects, features and advantages of the present invention will become apparent from a consideration of the following detailed description.

SUMMARY OF THE INVENTION

A video poker machine is provided with an auto hold feature that can be selectively turned on or off by the player. When the player uses the auto hold feature, the player plays against a first pay table which has a first theoretical game return. If the player does not use the auto hold feature, then the player plays against a second pay table with a slighter better theoretical game return than the first pay table.

DETAILED DESCRIPTION OF THE PREFERRED EMBODIMENTS

The present invention adds an auto hold feature to a game of video poker. This auto hold feature can be selectively turned on or off by the player video poker.

In conventional video poker, a player makes a wager to be able to play a hand of cards. After making the wager (which can be any number of coins, tokens or credits, but is usually a maximum wager of five credits), the player is dealt five cards face up. These first five cards are the player's initial hand or starting hand.

The player selects which cards, if any, the player wishes to hold from his initial hand. The unheld cards are discarded and replacement cards are dealt for the discarded cards. The final five card hand is analyzed to determine its poker hand ranking and the player is paid for winning poker hand rankings based on the amount of the player's wager. A pay table is displayed to the player showing the amounts that the player can win based on the poker hand ranking achieved by the player and the amount wagered by the player.

If the player does not use an auto hold feature during the play of video poker, the player must rely on his skill and knowledge of poker and the mathematical probabilities associated therewith to make the correct decisions regarding which cards to hold prior to the implementation of the draw step. If the player makes an error in selecting which cards to hold, the error will be reflected in the game return earned by the player.

When an auto hold feature is in use, the computer controls of the gaming machine analyze the initially displayed hand and suggest a HOLD to those cards that would give the player the best mathematical probability for that initial hand based on the pay table that is being used. The player can accept the suggested auto hold by pressing the DRAW location on the touch screen video display or the DRAW button on the button panel and the draw step will take place using the HOLD cards suggested by the auto hold. If the player declines the suggested auto hold, the player must unhold any cards that were held by the auto hold if the player wishes to discard those cards and the player must manually hold any other cards that the player wishes to hold. The use of an auto hold feature speeds up play by increasing the number of hands per hour that can be played on the gaming machine and also improves the player's chances of having a winning session during the play of video poker.

In the method of the present invention, the player who uses the auto hold would be playing against a first pay table that has a first game return. Any suitable pay table can be used, and a typical pay table with a first game return would be:

TABLE 1

| DRAW POKER | NUMBER OF COINS BET | | | | |
|---|---|---|---|---|---|
| POKER HAND | 1 | 2 | 3 | 4 | 5 |
| ROYAL FLUSH | 250 | 500 | 750 | 1000 | 4000 |
| STRAIGHT FLUSH | 50 | 100 | 150 | 200 | 250 |
| FOUR-OF-A-KIND | 25 | 50 | 75 | 100 | 125 |
| FULL HOUSE | 9 | 18 | 27 | 36 | 45 |
| FLUSH | 6 | 12 | 18 | 24 | 30 |
| STRAIGHT | 4 | 8 | 12 | 16 | 20 |
| THREE-OF-A-KIND | 3 | 6 | 9 | 12 | 15 |
| TWO PAIR | 2 | 4 | 6 | 8 | 10 |
| JACKS OR BETTER | 1 | 2 | 3 | 4 | 5 |

If the player decides to play the video poker game without the auto hold feature, the player will play against a second pay table with a second game return. Any suitable pay table can be used as long as the second pay table has a higher game return than the first pay table. A typical second pay table with the second higher game return would be:

TABLE 2

| DRAW POKER | NUMBER OF COINS BET | | | | |
|---|---|---|---|---|---|
| POKER HAND | 1 | 2 | 3 | 4 | 5 |
| ROYAL FLUSH | 250 | 500 | 750 | 1000 | 4000 |
| STRAIGHT FLUSH | 50 | 100 | 150 | 200 | 250 |
| FOUR-OF-A-KIND | 25 | 50 | 75 | 100 | 125 |
| FULL HOUSE | 10 | 20 | 30 | 40 | 50 |
| FLUSH | 7 | 14 | 21 | 28 | 35 |
| STRAIGHT | 4 | 8 | 12 | 16 | 20 |
| THREE-OF-A-KIND | 3 | 6 | 9 | 12 | 15 |
| TWO PAIR | 2 | 4 | 6 | 8 | 10 |
| JACKS OR BETTER | 1 | 2 | 3 | 4 | 5 |

This second pay table has a higher theoretical game return than the first pay table, which in this example is reflected in the payouts for the Full House and the Flush.

The higher game return for the second pay table can be provided by increasing the payouts in one, some or all of the winning poker hand rankings shown in the pay table.

While the pay tables shown above are based on regular Draw Poker format, the present invention can also be used with other pay tables for the other variations of draw poker, such as Deuces Wild Poker, Bonus Poker, Double Bonus Poker, Double Double Bonus Poker, Triple Bonus Poker, Joker's Wild Poker or any of the myriad of video poker formats that have been developed. Each of these video poker formats uses various arrangements of poker hand rankings as winning combinations and they use various payout amounts for the poker hand rankings. The method of the present invention can be applied to any of the various video poker formats discussed above.

While the invention has been illustrated with respect to several specific embodiments thereof, these embodiments should be considered as illustrative rather than limiting. Various modifications and additions may be made and will be apparent to those skilled in the art.

What is claimed is:

1. A method of playing a poker game that uses only a player's hand to determine winning or losing outcomes comprising:

a) providing a first pay table that is used if a player selects to play the poker game with an auto hold;

b) providing a second pay table that is used if the player selects to the play the poker game without the auto hold;

c) the player selecting to use the auto hold or to not use the auto hold;

d) dealing an initial player's hand of five cards all face up;

e) selecting none, one or more of the face up cards from the initial player's hand as cards to be held;

f) discarding from the initial player's hand the face up cards that were not selected to be held and replacing each of those cards with a face up card resulting in a final five card player's hand;

g) determining the poker hand ranking of the final player's hand;

h) providing the player an award based on the appropriate pay table if the poker hand ranking of the final player's hand is a winning hand.

2. The method of claim 1 in which the player makes a wager to participate in the game and the award is a monetary award based on the amount of the wager.

3. The method of claim 1 in which the second pay table has a higher theoretical game return than the first pay table.

* * * * *